US009995554B2

(12) United States Patent
Thompson

(10) Patent No.: US 9,995,554 B2
(45) Date of Patent: Jun. 12, 2018

(54) FIREARM BORE CLEANING APPARATUS, SYSTEMS AND METHODS

(71) Applicant: Ronald W. Thompson, Barrington, IL (US)

(72) Inventor: Ronald W. Thompson, Barrington, IL (US)

( * ) Notice: Subject to any disclaimer, the term of this patent is extended or adjusted under 35 U.S.C. 154(b) by 15 days.

(21) Appl. No.: 15/372,639

(22) Filed: Dec. 8, 2016

(65) Prior Publication Data

US 2017/0176126 A1 Jun. 22, 2017

Related U.S. Application Data

(60) Provisional application No. 62/387,301, filed on Dec. 22, 2015.

(51) Int. Cl.

| | |
|---|---|
| ***F41A 29/02*** | (2006.01) |
| ***B08B 9/04*** | (2006.01) |
| ***B08B 9/055*** | (2006.01) |
| ***B08B 1/00*** | (2006.01) |
| ***B08B 9/043*** | (2006.01) |

(52) U.S. Cl.

CPC ..... *F41A 29/02* (2013.01); *B08B 1/003* (2013.01); *B08B 1/006* (2013.01); *B08B 9/04* (2013.01); *B08B 9/0436* (2013.01); *B08B 9/055* (2013.01)

(58) Field of Classification Search

CPC ..... B08B 9/04; B08B 9/0436; B08B 9/027; F41A 29/02; E21B 37/02; A47L 13/16

USPC ..... 15/104.16, 104.165, 104.33, 104.02, 15/104.05; 42/95; 134/166 C

See application file for complete search history.

(56) References Cited

U.S. PATENT DOCUMENTS

| | | | | |
|---|---|---|---|---|
| 2,798,238 | A * | 7/1957 | Rogovin | F41A 29/02 15/104.16 |
| 3,064,294 | A | 11/1962 | Stocking | |
| 4,873,778 | A | 10/1989 | Stipp | |
| 8,572,883 | B2 * | 11/2013 | Markle | F41A 29/02 15/104.062 |
| 2014/0096796 | A1 * | 4/2014 | Frum | A47L 11/1625 134/6 |

* cited by examiner

*Primary Examiner* — Mikhail Kornakov
*Assistant Examiner* — Natasha N Campbell
(74) *Attorney, Agent, or Firm* — Stephen T. Scherrer; Monique A. Morneault; Scherrer Patent & Trademark Law, P.C.

(57) ABSTRACT

An apparatus, system and method for cleaning the internal bore of the barrel of a firearm, is provided. More specifically, an apparatus, system and method is provided for efficiently and effective cleaning the bore of a firearm, wherein a cleaning cloth or patch is easily attached and removed from the body of the apparatus using a magnetic attachment. The cleaning cloth drapes over the body of the apparatus, which then fits tight, but moveable, within the bore for maximum contact with the interior surface. The result is an improved firearm cleaning apparatus that not only provides for more effective and less time consuming cleaning, but it also requires less cleaning cloths and solvent, which results in less waste and thus is more environmentally friendly.

19 Claims, 6 Drawing Sheets

FIREARM BORE CLEANING APPARATUS, SYSTEMS AND METHODS

This application claims priority to U.S. Provisional Application Ser. No. 62/387,301 filed Dec. 22, 2015, which is incorporated in its entirety herein.

TECHNICAL FIELD

The present disclosure relates to apparatus, systems and methods for cleaning the bore of a barrel of a firearm. More specifically, an apparatus, system and method is provided for efficiently and effectively cleaning the bore of a firearm, wherein the apparatus is designed for easy attachment and removal of a cleaning cloth or patch that is used on the body of the apparatus. The apparatus, system and method is further designed to provide less waste in terms of both time spent cleaning and in cleaning materials. Additionally, the present apparatus, system and method is capable of cleaning firearms of various gauges and calibers.

BACKGROUND

Regular cleaning and maintenance of firearms is important for both extending and maintaining the useful life of the firearm, but is also a safety consideration. Firing ammunition deposits material including powder and shot residue inside the bore of the barrel, which can lead to contamination and corrosion. Additionally, excessive deposits of material inside the bore can become a potential safety hazard. Therefore, frequent and effective cleaning of the firearms, particularly after use is essential.

Traditionally, cleaning the firearm bore requires using a long cleaning rod having a cloth, brush or another end piece called a jag attached to the end of the rod. Brushes are typically used initially in conjunction with a solvent to loosen powder and shot residue inside a barrel. Jags, typically with a cleaning cloth or patch and secured to the end of the rod are commonly used to further remove the loosened residue. The cleaning cloth is soaked with a cleaning solvent or fluid, and then the cleaning rod is repeatedly pushed and pulled through the barrel of the gun to clean the inside from debris and other buildup.

Two types of prior art jags are shown in FIGS. 1 and 2. With regard to the jag in FIG. 1, the cleaning cloth or patch must be folded and fitted within the slot. It requires time and some patience to correctly orient the patch with respect to the slot so as to insure that the patch communicates with the bore of the barrel with as much surface area as possible. However, even then, the folded and crumpled orientation of the patch limits the amount of surface area the patch is able to contact within the barrel, resulting in less effective cleaning. Once the patch has been utilized by running it through the bore several times, it will become dirty, messy and cumbersome to remove from the slot without dispersing cleaning solvent and debris.

FIG. 2 depicts another type of jag generally referred to as a "brass jag". Using this jag requires securing strip of cloth or patch over the tip end of the jag and over the length of the brass jag to insure the patch contacts the bore of the barrel with as much surface area as possible. Once the patch has been utilized by running it through the bore several times, it too will become dirty and thus messy to remove, because the user must pull the used cloth from the brass jag. Dislodging the used cloth disperses messy debris throughout the work area.

A need exists for improved systems, apparatus and methods for effectively cleaning the bore of a firearm. Specifically, a need exists for an improved system, apparatus and method that provide a more effective, cleaner and economical manner for thoroughly cleaning the bore of a firearm.

A further need exists for providing a system, apparatus and method for cleaning the bore of a firearm that includes easy and secure attachment of the cleaning cloth to the present device.

A further need exists for providing a system, apparatus and method for cleaning the bore of a firearm that includes easy removal of the used cleaning cloth from the present device thereby avoiding dispersing solvent and debris into the surrounding area.

A further need exists for providing a system, apparatus and method for cleaning the bore of a firearm, wherein the whole of the cleaning cloth is used more effectively such that fewer passes are required through the barrel of the firearm for effective cleaning, resulting in less waste.

Further, a need exists for a system, apparatus and method for accommodating a variety of bore sizes for various types of firearms, from small caliber hand guns to military-style artillery.

SUMMARY

The present disclosure relates to systems, apparatus and methods for providing systems for cleaning the bore of a firearm. More specifically, a system, apparatus and method is provided for efficiently and effective cleaning the bore of a firearm, wherein the body of the apparatus is adapted for easy attachment and removal of a cleaning cloth or patch.

To this end, in an embodiment of the present disclosure, a firearm cleaning apparatus is provided. The apparatus comprises a shaft having a first threaded end and a second opposing threaded end, wherein the second threaded end further includes an extension end having a plurality of internal threads, a cylindrical body having a first end and a second end connected by a central bore, wherein the bore is configured for reception of the extension end of the shaft, a magnetic assembly attached to the second end of the cylindrical body, and, a retention element adapted for releaseably engaging the magnetic assembly.

In yet another embodiment, the cylindrical body has a diameter sized substantially for contact with the interior surface of the bore of a firearm barrel.

In another embodiment, firearm barrel cleaning device useful for cleaning an interior bore of the barrel, is provided. The device comprises a shaft having a first threaded end and a second opposing threaded end, a cylindrical body having a central bore for engagement with the second threaded end of the shaft, a first magnetic assembly attached to an end of the cylindrical body opposite the shaft, a retention element for coupling to the first magnetic assembly, and, a cleaning material section releasably secured between the first magnetic assembly and the retention element.

In yet another embodiment, a method for cleaning an interior surface of a barrel of a firearm, is provided. The method comprises the steps of providing a device for positioning within the barrel of the firearm, the device comprising a shaft having a cylindrical body attached to one end of the shaft, a magnetic assembly secured to an end of the cylindrical body opposite the shaft, a retention element for engagement with the magnetic assembly, securing a cleaning material portion between the magnetic assembly and the retention element, wrapping the cleaning material portion over the cylindrical body, attaching the device to a cleaning rod; and, inserting the device into the barrel of the firearm.

In another embodiment, a system for cleaning the barrel of a firearm is provided. The system comprises firearm cleaning apparatus comprising a shaft, a cylindrical body having an axial central bore, wherein the bore is configured for connection to a first end of the shaft, a magnetic assembly attached to an end of the cylindrical body opposite the shaft, and, a retention element adapted for releaseably engaging the magnetic assembly and for securing a cleaning cloth between the magnetic assembly and retention element, wherein the cleaning cloth substantially covers the cylindrical body and contacts an interior bore of the firearm when the apparatus is inserted into the barrel of the firearm.

It is, therefore, an advantage and objective of the present disclosure to a firearm cleaning apparatus, system and method for efficiently and effectively cleaning the interior surface of the bore of a barrel of a firearm requiring fewer cleaning steps and materials.

It is yet another advantage and objective of the present disclosure to provide a firearm cleaning apparatus, system and method that includes a quick and simple attachment of a cleaning material to the apparatus.

Another advantage and objective of the present disclosure is to provide a firearm cleaning apparatus, system and method that includes a quick and simple release of a used cleaning material from the apparatus.

Yet another advantage and objective of the present disclosure is to provide a firearm cleaning apparatus, system and method that effectively cleans the interior of a firearm barrel resulting in less waste of cleaning materials and time.

Moreover, it is another advantage and objective of the present disclosure to provide a firearm cleaning apparatus, system and method that is adaptable for a variety of bore sizes for various types of firearms, from small caliber hand guns to military-style artillery.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

The present disclosure relates to an apparatus, system and method for cleaning the internal bore of a firearm barrel. More specifically, an apparatus, system and method is provided for efficiently and effective cleaning the bore of a firearm, wherein a cleaning material, such as a cloth or patch is easily attached and removed from the body of the apparatus using a magnetic attachment. The cleaning cloth drapes over the body of the apparatus, which then fits tight, but moveable, within the bore for maximum contact with the interior surface. The result is an improved firearm cleaning apparatus that not only provides for more effective and less time consuming cleaning, but it also requires less cleaning cloths and solvent, which results in less waste and thus is more environmentally friendly.

Figure 1:
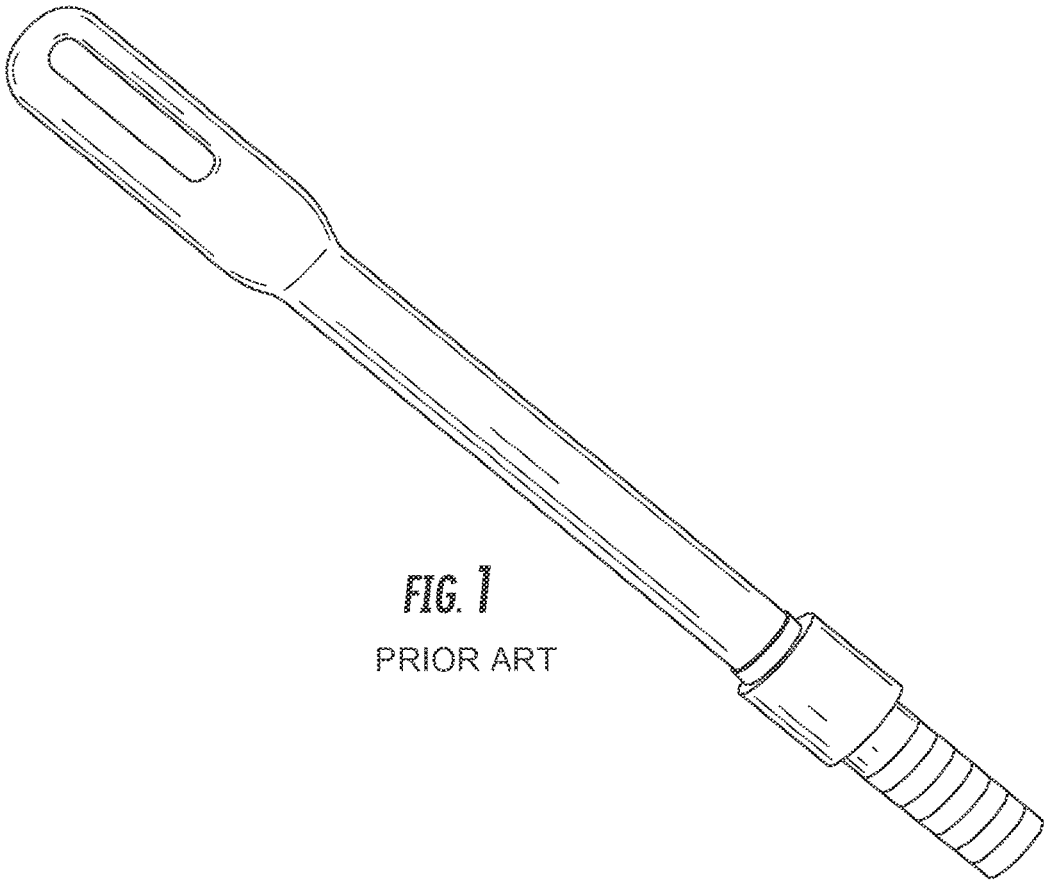
FIG. 1 PRIOR ART
FIGS. 1 and 2 illustrate embodiments of prior art cleaning devices for cleaning the barrel of a firearm.
Figure 2:
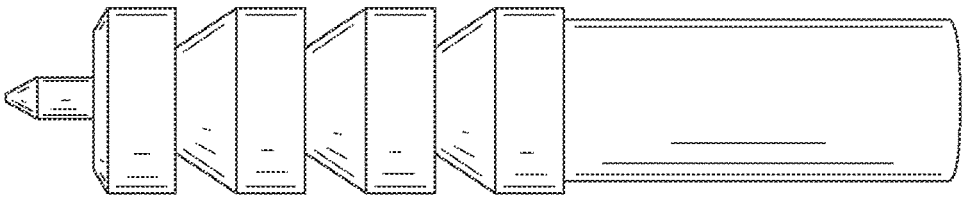
FIG. 2 PRIOR ART
Figure 3:
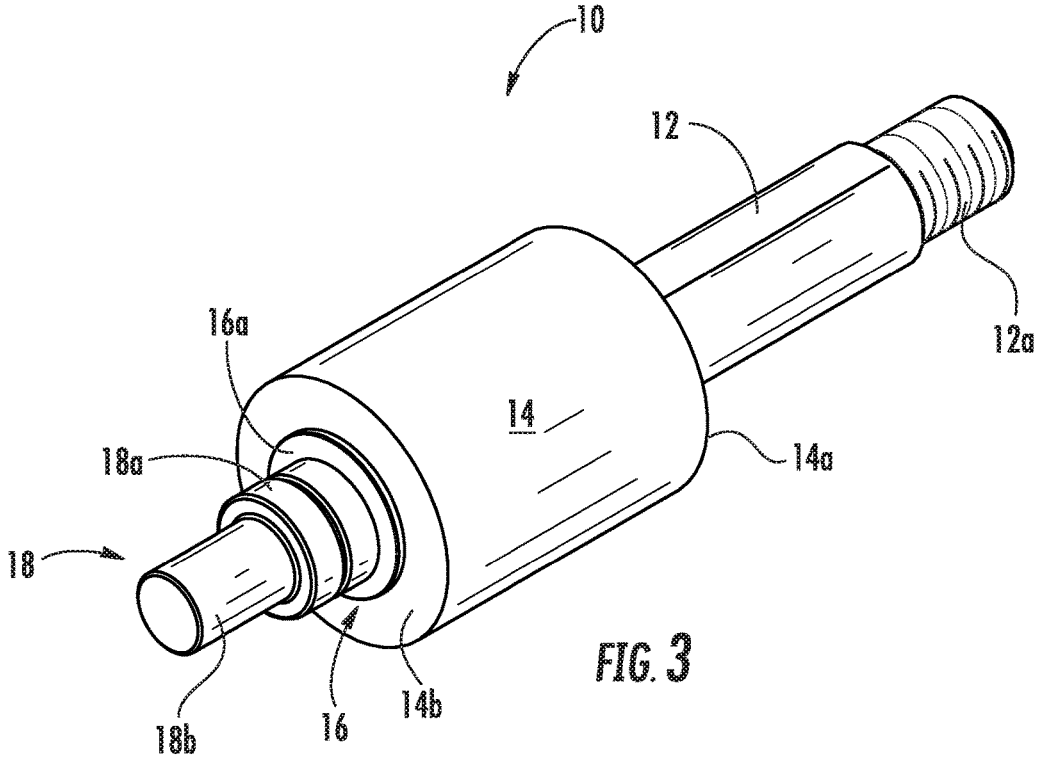
FIG. 3 illustrates a perspective view of the firearm cleaning apparatus of the present disclosure.
Figure 4:
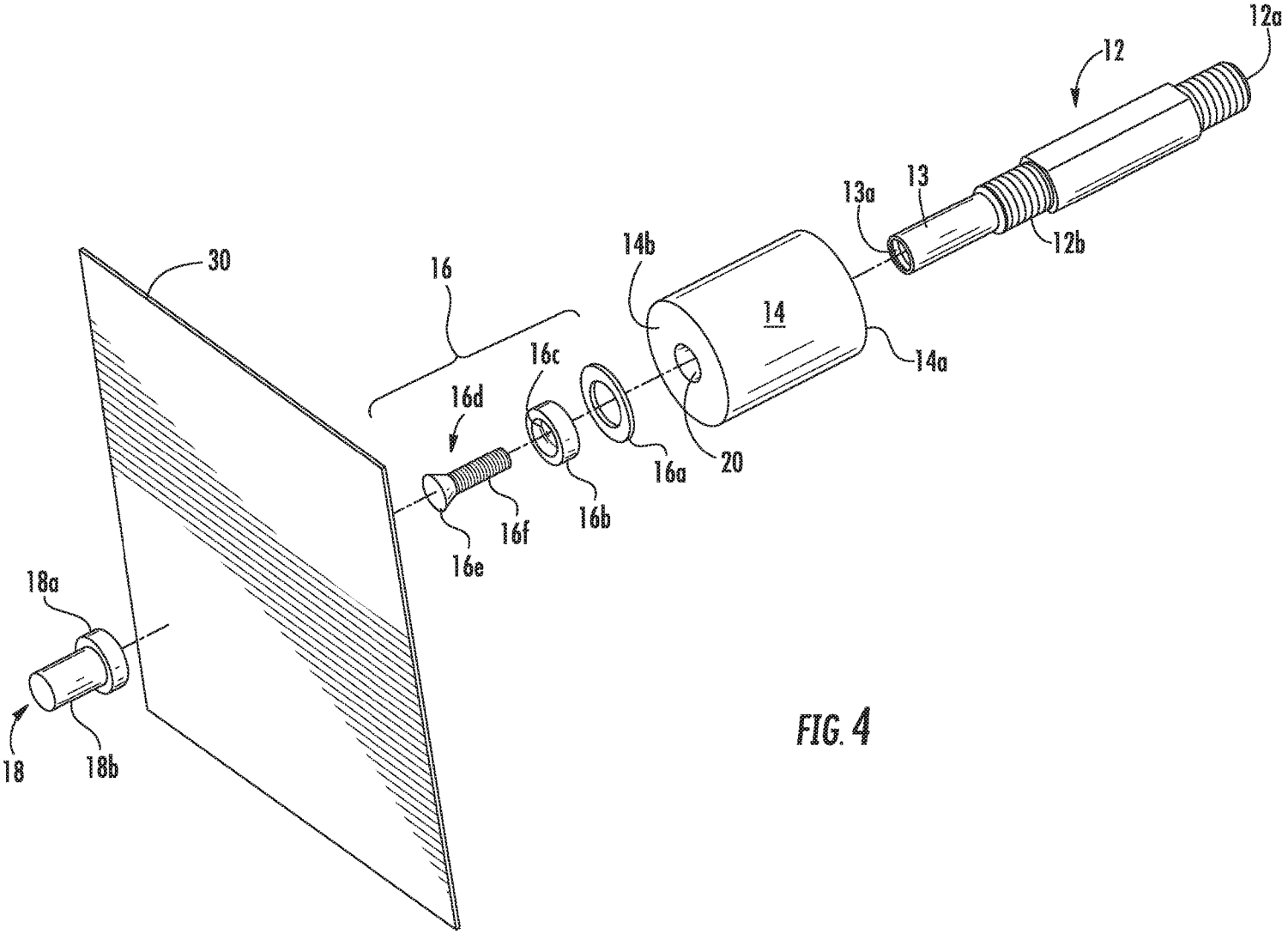
FIG. 4 illustrates an exploded view of the firearm cleaning apparatus of the present disclosure.
Figure 5:
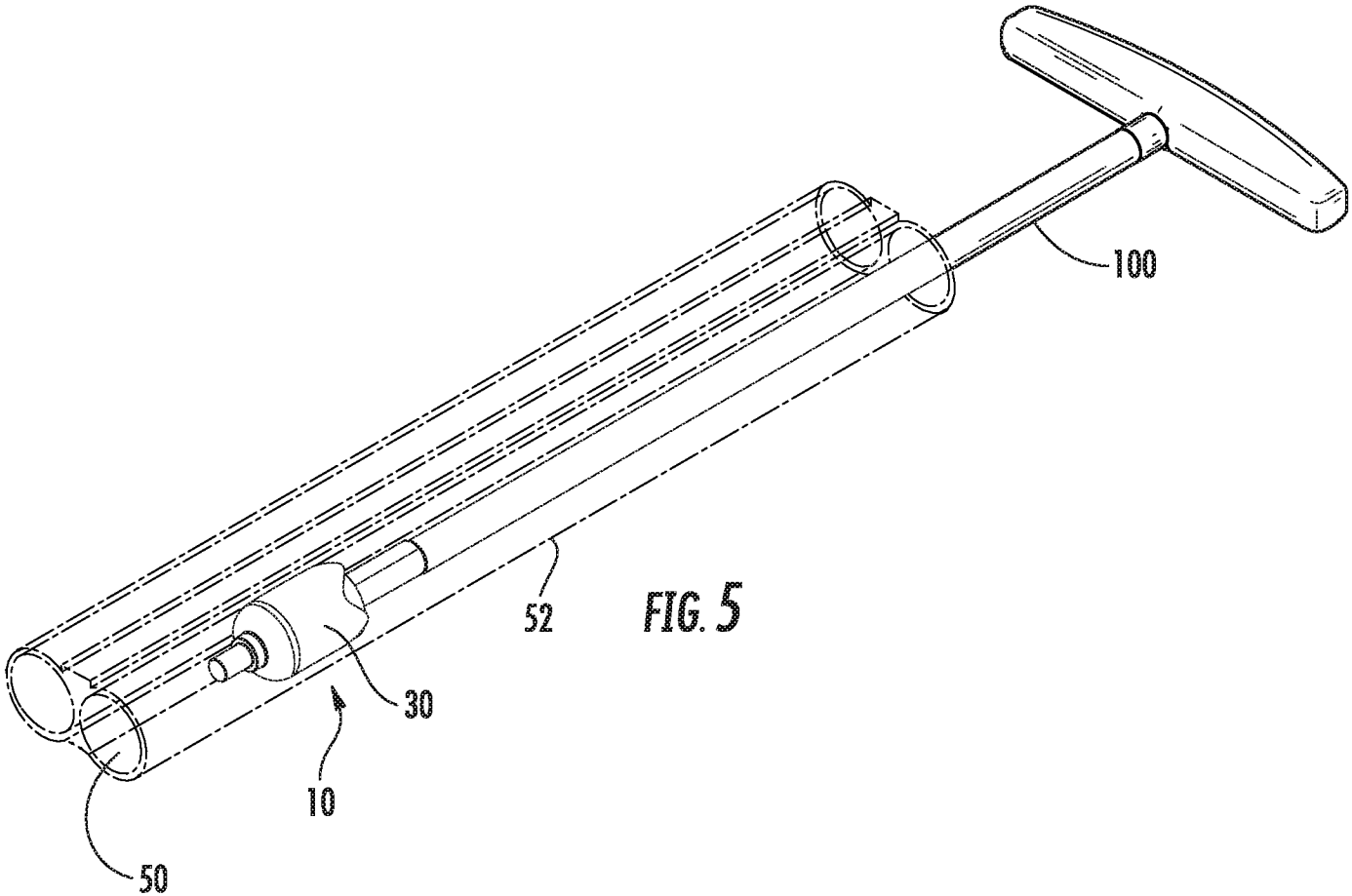
FIG. 5 illustrates the firearm cleaning apparatus of the present disclosure in use on a cleaning rod, and inserted into the barrel of a firearm; and, FIG. 6 illustrates a used cleaning cloth or patch after successive cleanings with the firearm cleaning apparatus of the present disclosure.
Figure 6:
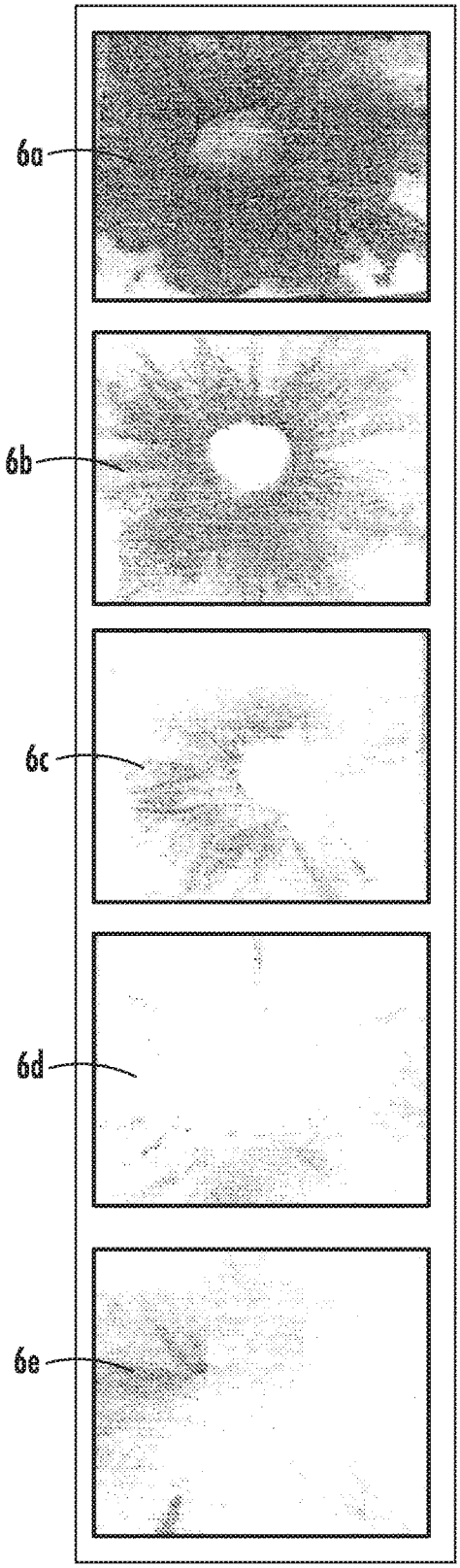

Now referring to the figures, wherein like numerals refer to like parts, FIGS. 1 and 2 illustrate prior art embodiments of firearm barrel cleaning apparatus. FIGS. 3 and 4 illustrate an embodiment of the present firearm cleaning apparatus 10 of the present disclosure, while 4A illustrates the retention element of the firearm cleaning apparatus. FIG. 5 illustrates an embodiment of the present firearm barrel cleaning apparatus in use. FIG. 6 illustrates a sequence of cleaning patches after successive cleanings with the firearm cleaning apparatus of the present disclosure.

Referring now to FIGS. 3 and 4, there is shown an embodiment of the firearm cleaning apparatus 10 of the present disclosure. The firearm cleaning apparatus 10 includes a shaft 12 connected to a cylindrical body 14, a magnetic assembly 16 attached to the cylindrical body and, a retention element 18 adapted for releaseably engaging the magnetic assembly. The apparatus 10 is used to secure a cleaning cloth or patch 30, typically a cotton cloth, to which a cleaning solvent and/or oil is applied for cleaning the bore 50 of a barrel 52 of a firearm (FIG. 5).

As shown in FIG. 4, the shaft 12 is generally an elongated rod having a first threaded end 12*a*, and a second threaded end 12*b*, which includes a further extension end 13 projecting from the second threaded end. The interior 13*a* of the extension end 13 includes a plurality of threads 13*a*. The first threaded end 12*a* is designed to connect with a long cleaning rod 100, which is used to insert the firearm cleaning apparatus 10 into the bore 50 of the barrel 52 of a firearm (FIG. 5). The second threaded end 12*b* of the shaft is adapted for engagement with the interior of the cylindrical body 14. The shaft 12 can be constructed from any durable material including metals and a variety of plastics, including polypropylene, polyethylene or any combination thereof, and nylon.

The shaft 12 connects with the cylindrical body 14 through its second threaded end 12*b*. Specifically, the cylindrical body 14 includes a central bore 20, running axially from a first end 14*a* of the cylindrical body to the second end 14*b* of the cylindrical body. The second threaded end 12*b* of the shaft 12 is inserted into the central bore 20 at the first end 14*a* of the cylindrical body, and the corresponding threads of the second end connect with the internal threads of the central bore, thereby securing the shaft to the cylindrical body. In this manner, the cylindrical body 14 can be secured to the shaft 12 without the need for adhesives. Additionally, the threaded engagement permits the parts to be interchangeable, as needed.

The cylindrical body 14 can be constructed from any suitable material, but preferably a non-porous, flexible material, such as a polyethylene foam. Specifically, the material is a cross-linked, non-porous, closed cell polyethylene foam having a density ranging from 2 lbs to 6 lbs. Density of the foam used for the cylindrical body 14 of the present disclosure may be effected by the barrel size of the firearm in which it will be used. For example, a larger barrel bore firearm, will require a higher density foam, than a smaller barrel bore firearm.

It is also important that the material used to construct the cylindrical body 14 is not affected by, nor will it react with or absorb, the solvent and or oil used for cleaning the barrel of the firearm. Thus, a Class A, military grade, non-abrasive foam material is preferred. Additionally, it is desirable that the material have some flexibility or give so that it can fit snug within the barrel of the firearm when the cleaning material is draped around the cylindrical body 14, and be slid through the barrel once inserted. Preferably, the cylindrical body 14 has a diameter slightly larger than the inner diameter of the barrel of the firearm, so that when the cylindrical body with the attached cleaning cloth or patch 30 is inserted into the barrel, the tight fit provides effective surface contact for efficient cleaning.

Positioned on the second end 14*b* of the cylindrical body 14 is a magnetic assembly 16. As shown in FIG. 4, the magnetic assembly 16 includes a spacer 16*a*, a magnet 16*b* having a center opening 16*c*, and a fastener 16*d*. The magnet 16*b* as shown is circular in shape, with the center opening 16*c* designed for receiving the fastener 16*d*; however, it should be understood that the magnet can have any suitable size or shape to correspond with the cylindrical body 14. Additionally, the magnet 16*b* can be constructed from neodymium—iron—boron magnet or other ferrous metal.

Figure 4A:
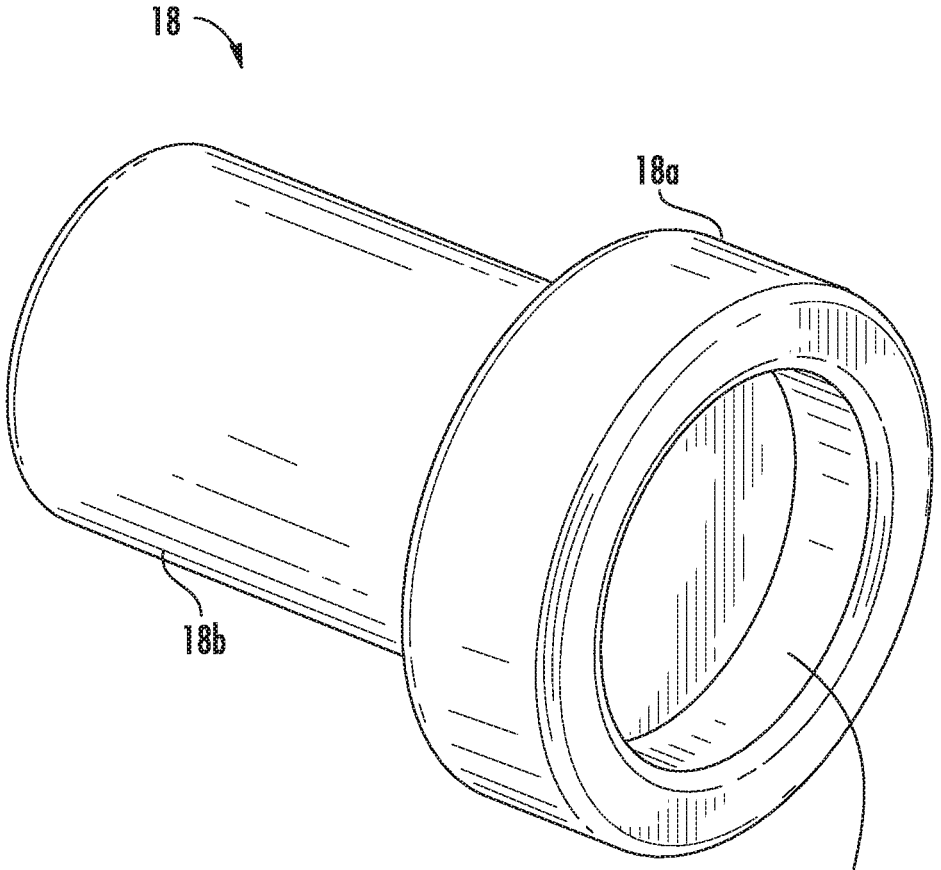
FIG. 4A illustrates an embodiment of a retention element of the firearm cleaning apparatus of the present disclosure.

To secure the magnetic assembly 16 to the cylindrical body 14, the spacer 16*a* is secured to the second end 14*b* of the cylindrical body 14 along with the magnet 16*b*, using a fastener 16*d*, such as a screw, as shown. The screw 16*d* is inserted into the center opening 16*c* of the magnet 16*b* and then through the spacer 16*a*. The spacer 16*a* and magnet 16*b* assembly is then attached to the end 13 of the shaft 12, wherein the fastener 16*d* engages with the internal threads 13*a* of the shaft end 13, which is inserted into the central bore 20 of the cylindrical body 14. The top portion or head 16*e* of the screw 16*d* is designed to protrude slightly above (not flush with) the center opening 16*c* of the magnet 16*b* for engagement with the indentation or recessed end 22 of a retention device 18 (FIG. 4A). The magnet 16*b* is counter sunk to allow the fastener 16*d* to center the magnet 16*b* and spacer 16*a*, which insures these components align properly when affixed to the shaft 12. Alignment of the magnet 16*b* and fastener 16*d* is important for further alignment of the retention element 18, which provides a secure connection for the cleaning cloth 30, which will be described below.

Referring to FIGS. 3 and 4, the retention element 18 is shown on the end of the apparatus 10. The retention element 18 includes a ring-shaped body 18*a* and a stem 18*b*. In one embodiment, the retention element 18 is constructed from any suitable metal, but specifically a metal which is capable of being attracted to the magnetic assembly 16. Suitable metals include nickel, iron, steel or a combination thereof. For example, a stainless steel material capable of magnetic attraction to the magnetic assembly 16 can be used for construction of the retention element 18. It is the pulling force of the magnetic field of the magnet assembly 16 on the retention element 18 that retains the cleaning patch 30 or cloth between the magnetic assembly and the retention element.

In FIG. 3, the retention element 18 is shown connected directly to the magnetic assembly 16, without a cleaning patch or cloth. As shown in FIG. 4A, the body 18*a* of the retention element 18 includes a cavity or indentation 22. Thus, when the retention element 18 is connected directly to the magnetic assembly 16, the top or head 16*e* of the fastener 16*d* engages the indentation 22 of the body of the retention element 18 forming a secure fit. As mentioned above, the alignment of the magnetic assembly is likewise important for alignment of the retention element 18, so that the retention element remains straight as the apparatus 10 is inserted into the barrel of the firearm.

Additionally, the engagement of the top 16*e* of the fastener 16*d* with the indentation 22 is further advantageous because the magnetic engagement of the fastener head 16*e* within the indentation 22 provides a tight connection and secures the cleaning patch or cloth 30 into position between the magnetic assembly 16 and the retention element 18. In this manner, the cleaning cloth 30 stays in position between the magnetic assembly 16 and the retention element 18, and draped around the cylindrical body 14 when the apparatus 10 is inserted into the bore 50 of the barrel 52 firearm, as shown in FIG. 5. Yet, the magnetic connection of the magnetic assembly 16 and the retention element 18 also provides for easy removal of the used cleaning cloth 30. The user simply grasps the stem 18*b* of the retention element and pulling it away from the magnetic assembly, which easily releases the magnetic pull and the used cloth without dispersing debris and solvent from the cloth.

To use the firearm cleaning apparatus 10 of the present disclosure, the first threaded end 12*a* of the shaft 12 is secured to a cleaning rod 100. An appropriately sized cleaning cloth or patch 30 is positioned, so that when it is retained between the magnetic assembly 16 and the retention element 18, the cleaning cloth will cover or drape over the majority or all of the cylindrical body 14. As illustrated in FIG. 5, the apparatus 10 is inserted into the bore 50 of the barrel 52 of a firearm, where the cylindrical body 14 with the overlapping cleaning cloth 30 fits snugly within the bore, offering superior contact with the inner walls of the bore. Although in some prior art cleaning methods, the jag can be inserted and removed in a back and forth motion within the barrel, it is preferable to use the present firearm cleaning apparatus 10 in a series of single passes in one direction into and out of the barrel. The apparatus 10 is then reinserted again for another pass, up to as many passes as required to complete the cleaning process.

For example, and referring now to FIG. 6, there is shown a sequence of cleaning cloths used in conjunction with the firearm cleaning apparatus 10 of the present disclosure. From top to bottom, FIG. 6*a* illustrates the patch 30 after being dipped or sprayed with a solvent and passed through a barrel (for example, as shown as 52 in FIG. 5) a first time. FIG. 6*b* illustrates the patch again dipped or sprayed with a solvent and passed through the barrel a second time. FIG. 6*c* illustrates a patch that is dry and passed through the barrel a third time to remove any excess solvent and/or residue. FIG. 6*d* illustrates a patch that is dry and passed through the barrel a fourth time to remove any excess solvent and/or residue. FIG. 6*e* illustrates a patch dipped or sprayed in oil, and passed a fifth and final time through the barrel. Thus, a total of only five passes were required using the firearm cleaning apparatus 10 of the present disclosure. The improved effectiveness of the present firearm cleaning apparatus 10 is evident from the cleanliness of the sequence shown in FIG. 6*a*-6*e*.

It should be noted that the firearm cleaning apparatus of the present disclosure can be adapted for use with a variety of calibers of firearms. For example, various diameters of the cylindrical body 14, as well as, varying sizes of cleaning cloths 30 can be used to accommodate a variety of barrel dimensions. For example, a cylindrical body sized for a 20 gauge shotgun will be narrower than one sized to fit a 12 gauge shotgun, thus insuring optimal contact by the cleaning patch 30 with the interior of the barrel. Additionally, various modifications can be made to other components, such as the shaft 12, magnet assembly 16, and retention element 18 to accommodate cylindrical bodies 14 of varying dimensions.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. A firearm cleaning apparatus comprising:

a shaft having a first threaded end and a second opposing threaded end, wherein the second threaded end further includes an extension end having a plurality of internal threads;

a cylindrical body having a first end and a second end connected by a central bore, wherein the bore is configured for reception of the extension end of the shaft;

a magnetic assembly attached to the second end of the cylindrical body; and, a retention element adapted for releaseably engaging the magnetic assembly.

2. The firearm cleaning apparatus of claim 1, wherein the first threaded end of the shaft is adapted for engagement with a cleaning rod.

3. The firearm cleaning apparatus of claim 1, wherein the cylindrical body has an outer diameter sized substantially for engagement with an interior surface of a firearm barrel.

4. The firearm cleaning apparatus of claim 1, wherein the magnetic assembly further includes a spacer positioned on the second end of the cylindrical body.

5. The firearm cleaning apparatus of claim 4, wherein the first magnetic assembly further includes a magnet secured against the spacer by a fastener.

6. The firearm cleaning apparatus of claim 5, wherein the fastener includes a screw communicating with the internal threads of the extension end of the shaft.

7. The firearm cleaning apparatus of claim 1, wherein the retention element further includes an indentation configured for coupling with the fastener of the magnetic assembly.

8. The firearm cleaning apparatus of claim 1, wherein the apparatus further includes a cleaning material portion releasably secured between the magnetic assembly and the retention element when the magnetic assembly and retention element are coupled together.

9. The firearm cleaning apparatus of claim 8, wherein the cleaning material portion substantially covers the cylindrical body when secured between the magnetic assembly and the retention element.

10. A firearm barrel cleaning device useful for cleaning an interior bore of the barrel, the device comprising:

a shaft having a first threaded end and a second opposing threaded end;

a cylindrical body having a central bore for engagement with the second threaded end of the shaft, wherein the cylindrical body has an outer diameter suitable for engaging an interior surface of the bore of the barrel;

a first magnetic assembly attached to an end of the cylindrical body opposite the shaft;

a retention element adapted for releaseably engaging the magnetic assembly; and, a cleaning material releasably secured between the first magnetic assembly and the retention element.

11. The firearm barrel cleaning device of claim 10, wherein the first magnetic assembly comprises a magnetic body connected to the cylindrical body using a fastener.

12. The firearm barrel cleaning device of claim 11, wherein the retention element is adapted for engagement with the fastener of the first magnetic assembly.

13. The firearm barrel cleaning device of claim 12, wherein the retention element further includes an indentation for engagement with the fastener of the first magnetic assembly.

14. The firearm barrel cleaning device of claim 12, wherein the retention element further includes a stem end.

15. A method for cleaning an interior surface of a barrel of a firearm, the method comprising the steps of:

providing a device for positioning within the barrel of the firearm, the device comprising:

a shaft having a first threaded end and a second opposing threaded end, wherein the second threaded end further includes an extension end having a plurality of internal threads;

a cylindrical body having a first end and a second end connected by a central bore, wherein the bore is configured for reception of the extension end of the shaft;

a magnetic assembly secured to the second end of the cylindrical body opposite the shaft, a retention element for releasable engagement with the magnetic assembly;

securing a cleaning material portion between the magnetic assembly and the retention element;

draping the cleaning material portion over the cylindrical body under the magnetic assembly;

attaching the device to a cleaning rod; and, inserting the device into the barrel of the firearm.

16. The method for cleaning the interior surface of the barrel of a firearm of claim 15, wherein the method further includes the step of inserting the device into the barrel so that the cleaning material portion substantially contacts the interior surface of the barrel of the firearm.

17. The method for cleaning the interior surface of the barrel of a firearm of claim 15, wherein the method further includes passing the device through the barrel of the firearm until the interior surface is clean.

18. The method for cleaning the interior surface of the barrel of a firearm of claim 17, wherein the step of passing the device through the barrel of the firearm further includes moving the device in one direction through the barrel of the firearm.

19. The method for cleaning the interior surface of the barrel of a firearm of claim 15, wherein the method further includes releasing the cleaning material portion by disengaging the retention element from the magnetic assembly.

* * * * *